United States Patent [19]

Fields

[11] Patent Number: 4,696,372

[45] Date of Patent: Sep. 29, 1987

[54] PORTABLE STEP AND CARRYING DEVICE FOR STUD WALLS

[76] Inventor: Tom R. Fields, 5714 Verner Oak Ct., Sacramento, Calif. 95841

[21] Appl. No.: 856,947

[22] Filed: Apr. 28, 1986

Related U.S. Application Data

[63] . Continuation of Ser. No. 626,766, Jul. 2, 1984, abandoned.

[51] Int. Cl.[4] ..... E04G 3/00

[52] U.S. Cl. ..... 182/92; 182/120; 182/134; 182/228; 52/749

[58] Field of Search ..... 52/749, 183; 182/120, 182/92, 228, 91, 220, 90, 134; 24/523

[56] References Cited

U.S. PATENT DOCUMENTS 3,004,622 10/1961 Ringer ..... 182/134

3,336,642 8/1967 Armacost ..... 24/523

3,561,563 2/1971 Harsh ..... 182/92

FOREIGN PATENT DOCUMENTS 1483752 5/1967 France ..... 182/134

313127 5/1956 Switzerland ..... 182/92

*Primary Examiner*—Carl D. Friedman

*Assistant Examiner*—Naoko N. Slack

[57] ABSTRACT

A portable step-forming device releasably attachable to a vertical wooden stud comprises a U-shaped gripping member for closely receiving a stud member, a step member attached to one prong of the U-shaped member and further having an enlarged end for retaining the user's foot on the step member, and a gripping means comprising a spring-loaded reciprocable member with a stud-engaging end for holding the step-forming device in position of the stud member.

6 Claims, 5 Drawing Figures

PORTABLE STEP AND CARRYING DEVICE FOR STUD WALLS

This application is a continuation of prior U.S. application Ser. No. 626,766, filed 7-2-84, now abandoned.

BACKGROUND OF THE INVENTION

1. Field of the Invention

The invention relates to a portable step-forming device for use on open studwalls to provide a temporary step enabling a worker to reach high places. In addition, the device may be used to engage a fabricated studwall prior to its erection, for carrying the studwall.

2. Description of the Prior Art

In various industries, such as the electrical and construction industries, it is often necessary to support one or more studs, such as a two by four, four by fours, etc. in a fixed position while certain operations are carried out. Such studs normally vary slightly in dimensions so it is impossible to utilize stud holders of fixed dimensions. Also, it is desirable to secure such studs in such support members in a quick and easy manner, accomodate studs of varying thicknesses, retain them in a fixed immovable position until such studs are no longer necessary, then release the studs for re-use elsewhere. Such support members must be easy to use, inexpensive and easily transportable and reusable.

There thus exists a need for a stud support member or device which is easy to use to support a stud in a fixed position, then easy to use for re-use elsewhere.

In addition to the above purpose of supporting a stud, and as a primary purpose of the invention, the device can be used as support by providing a step for construction workers to raise themselves up to a higher level to perform a task.

SUMMARY OF THE INVENTION

It is a primary object of the invention to provide a portable step-forming device releasably attachable to a vertical wooden stud of an open studwall to form a step usable in performing work on or about the studwall. Another object is the efficient preferred method of use of the device, and a further object is another method of use by which the device provides a carrying handle for a prefabricated studwall.

These and other objects are preferably accomplished by providing a stud holding device including a base and an upstanding hollow support member having a flange at the top for receiving a stud therein. A coiled spring is disposed internally within the support member and biases a stud engaging member into contact with the stud retained within the flange. In the arrangement described, a stud is securely retained within the flange and supported by the support member for use in construction or the like.

DESCRIPTION OF THE PREFERRED EMBODIMENT

Figure 1:
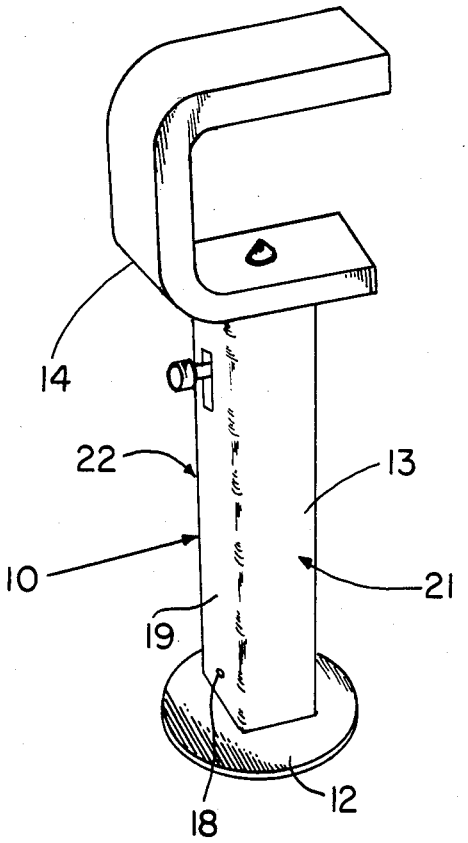
FIG. 1 is a perspective view of a stud holding device in accordance with the invention.

Reference is now made to FIG. 1 wherein the device of the instant invention is shown. This device while intended primarily as a quick attach/quick release step to be secured to vertical joists such as 2×4s, may also be employed as a stud holding of studwall carrying apparatus.

In FIG. 1, the device 10 is seen to be standing up on a supporting surface. Device 10 includes a base or plate 12, an upstanding hollow support member or step member 13 and a generally U-shaped flange or gripping member 14 which is fixedly secured at the top of the support member 13.

Figure 2:
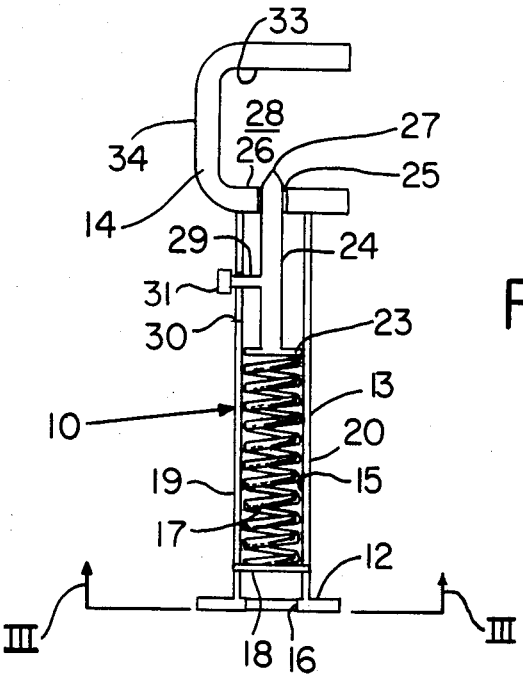
FIG. 2 is a vertical cross-sectional view of the device of FIG. 1.
Figure 3:
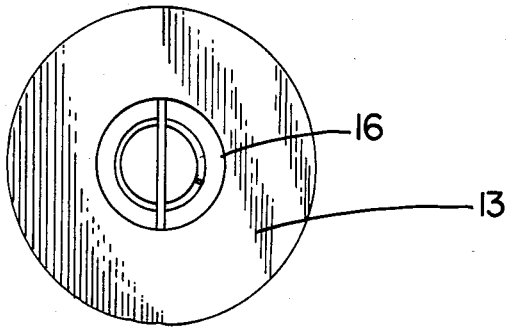
FIG. 3 is a view taken along lines III—III of FIG. 2.

As shown in FIG. 2, the interior of member 13 is hollow having an inner wall 15. Base 12 (FIG. 3) is shown as round (although it can be any suitable configuration) having an opening 16 therein. As seen in FIG. 2, a coiled spring 17 is disposed internally of member 13. A pin 18 is mounted in member 13 above base 12 extending through a suitable opening in sidewall 19 to wall 20 and secured therein in any suitable manner. As seen in FIG. 2, the lowermost end of coiled spring 17 abuts against and is stopped by engagement with pin 18 (see also FIG. 3).

As seen in FIG. 1, member 13 is shown as square-shaped in cross-section having aforementioned side walls 19,20 and front and rear walls 21,22 (FIGS. 1 and 2, respectively). Of course, member 13 can be of any suitable configuration, such as round, oval, etc.

As seen in FIG. 2, upward movement of spring 17 within member 13 is arrested by a plate 23 resting on the upper surface thereof. Plate 23 may be square-shaped (to conform to the internal configuration on inner wall 15), round or otherwise conforming to the interior configuration of member 13.

It is to be understood that spring 17 normally biases plate 23 upwardly within member 13. A reciprocable stud engaging pin or member 24 extends upwardly from plate 23, generally from the midpoint thereof and secured thereto, and out of an aperture 25 formed in a first prong or leg 26 of U-shaped flange 14. Flange 14 is of course fixedly secured to the top of member 13 in any suitable manner. An opposite prong 33 is connected to the frist prong 26 by a bight portion 34, to form the U-shaped gripping member 14 as shown. The two prongs have essentially planar faces for engaging a stud, with linear edges for gripping a wooden stud when the device is placed on a wall stud and the user's weight is applied.

The reciprocable member 24 is tapered at a stud-engaging pointed end 27 thereof. As seen in FIG. 2, the tapered point or end 27 of pin 24 normally extends a short distance into the area 28 internally of flange 14. Outward movement of pin 24 is arrested by a cross pin 29 fixedly secured to pin 24 below opening 25 and above plate 23 extending normal to pin 24 and out of an opening 30 in side wall 19. A knurled head 31 is mounted on the terminal end of pin 29 for grasping the same and the upper and lower edges of opening 30 provide upper and lower stops for controlling the upward and downward movements, respectively, of pin 24.

Figure 4:
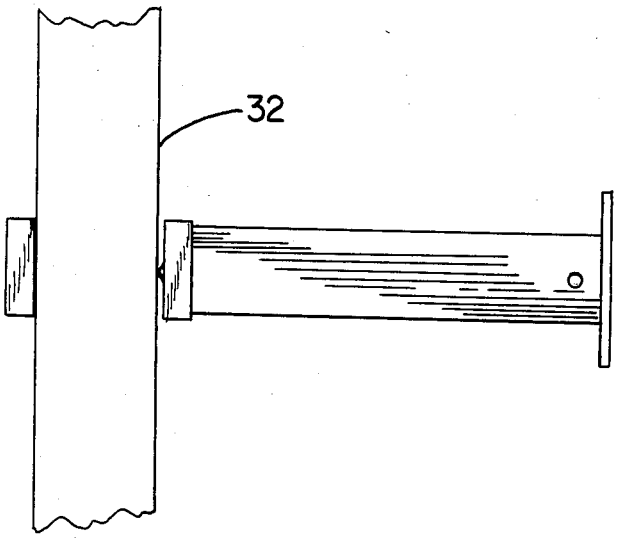
FIG. 4 is a vertical view of the device of FIGS. 1 to 3 shown as supporting a stud.
Figure 5:
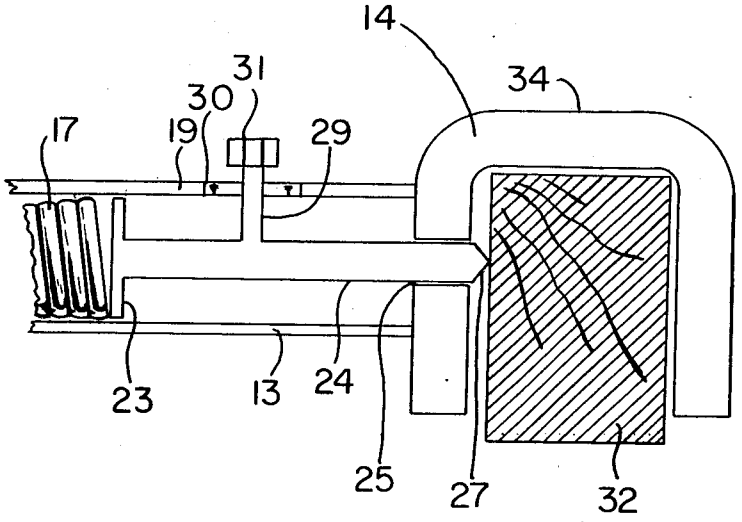
FIG. 5 is a cross-sectional view of the upper portion of the device of FIG. 4 supporting a stud.

The operation of the instant device 10 will now be described. The device 10 is located in its FIG. 1 position and head 31 is grasped by the operator and pushed or pulled downwardly thereby compressing spring 17 within member 13. At the same time, a stud 32 (FIG. 4) is inserted into the area 28 of flange 14 between upper flange wall 33 (FIG. 2) and lower flange wall 26 and against interconnecting side flange wall or bight portion 34 (FIG. 2), or the device 10 is inserted over a stud of an open studwall. As seen in FIG. 5, stud 32 is engaged by the point 27 of pin 24 thus forcing plate 23 against the bias of spring 17. In this manner, the bias of spring 17 forces point 27 against stud 32 to hold it firmly within flange 14 thereby compensating for any variation in dimensions of stud 32 and holding it tight. Stud 32 is thus held in a firm stable manner until it is desired to release the same. At this time, the pin 29 is moved downwardly a short distance sufficient to loosen stud 32 within flange 14 or stud 32 is moved so as to permit removal of the stud with pin 24 returning to the FIG. 2 position.

The dual useage device of this invention is actuated in like manner whether it is being used to grasp or secure a stud or whether the stud is receiving the device such that it can serve as a step. Either way, it is necessary to firmly secure the device 10 to the piece of wood 32 to prevent its slipping down the vertical stud prior the user's weight being applied, in the case of its use as a step. Obviously if the device is to serve as a step for a carpenter adequate spacing must be provided between adjacent vertical members, usually sixteen (16) inches on center to permit the user to insert the device into its normal to the stud disposition, i.e., generally horizontally.

As seen in the drawings, the entire step-forming device 10 lies in a single general plane, perpendicular to the planar faces of the prongs 26 and 33 of the U-shaped gripping member 14.

The flange 14, base 12 and member 13 may be made of any suitable materials, such as metal, polycarbonate or ABS plastic. If made of metal, the various components may be welded together. Flange 14 may be sized for any suitable stud, such as 2×4, 4×4, etc, and, if desired, can be removably mounted to the top of member 13 so that flanges of varying dimensions may be easily interchanged.

Spring 17 is also of any suitable material and of sufficient resiliency to urge plate 23 upwardly. Cross pin 29 and pin 24 are also of any suitable materials and pin 29 may be threaded into a threaded aperture in pin 24 and have a threaded end with cap or head 31 threaded thereon.

The internal surfaces of flange 14 which engage stud 32 may be roughened or ribbed or the like for providing a better grip on stud 32. Also, the lower wall 26 of flange 14 may be studded or provided with points that dig into studs 32.

Various refinements may also be made. For example, the device 10 can be provided with a loop or hook on base 12 or elsewhere for easy carrying of the same or hanging on a hook. A bag may be provided for storing the same.

It can be seen that there is disclosed a stud holding device that is easily transportable and usable, can be used by carpenters, electricians and construction people, adapts to studs of varying dimensions and holds such studs firmly in position. One or more such devices can be used and various operations can be carried out on the studs held by such devices. The studs can then be released and the devices reused to hold other studs.

In addition, the stud having one or more of the instant devices mounted thereto permits the construction worker to step up to a higher elevation by placing his or her feet on the upstanding support member of said device while the flange of said device is engaged with a stud, whereby the worker can perform needed tasks.

It is further seen that the base acts as a shoe or boot holder to prevent lateral movement while the foot is in place on the device during engagement of the flange thereof with said stud. This makes for a more surefooted climb.

When employed as a step, it may be beneficial to mount a sandpaper type layer on both of the horizontally disposed surfaces of the hollow member to ensure sure foodtedness by the user. Such non-slip tread surfaces are available in the marketplace from the 3M Co.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A portable step-forming device releasably attachable to a vertical wooden stud of an open studwall to form a step usable in performing work on or about the studwall, comprising:

a U-shaped gripping member having two opposed prongs lying parallel to each other in a first general plane, the two prongs being spaced apart slightly more widely than the thickness of a stud, with a bight portion joining the prongs at one end to form the U-shaped member so that a stud can be closely received in the U-shaped member between the prongs;

a step member fixedly attached to an outer side of one prong of the gripping member so that it extends perpendicularly from the prong and lies in said first generaly plane with the two prongs, the step member being of a length sufficient to receive transversely a foot of a user;

an enlarged outer end of the step member for helping retain the foot of the user on the step member;

each prong having an inner stud-facing side with generally linear, parallel, spaced apart upper and lower edges which define second and third planes, one at each prong, the second and third planes being substantially perpendicular to the first plane and parallel to each other;

gripping means for holding the step-forming device in position after the device has been placed on a wall stud and prior to a user's stepping on the step member, the gripping means comprising a spring-loaded reciprocable member having a stud-engaging end and wherein the step member is hollow and contains the reciprocable member for sliding movement therein with the stud-engaging end extending through an opening in said one prong;

whereby, with the step-forming device retained in position on a stud by the gripping means, when the user's weight is applied to the step member the step-forming device tends to tip or pivot on the wooden stud, causing the lower edge of one prong and the upper edge of the other prong to press into the wooden stud and to tightly grip the stud, preventing slipping of the device as the weight of the user is carried, and whereby the step-forming device may be placed on a stud, from the same side of the studwall, to extend the step member to the right.

2. The step-forming device of claim 1, wherein the spring-loaded reciprocable member is biased toward the stud by a compression coil spring within the hollow step, and further including a manually operable handle extending transversely from the reciprocable member for enabling its manual retraction against the force of the spring.

3. The step-forming device of claim 1, wherein the stud-engaging end has a point for engaging into the wooden stud.

4. The step-forming device of claim 1, wherein the enlarged end of the step member comprises a generally circular plate affixed transversely at the end of the step member.

5. A method for providing a temporary step on an open studwall for use by a worker performing work at out-of-reach heights on or near the studwall, comprising;

providing a portable step-forming device having a U-shaped gripping member with two opposed prongs lying parallel to each other in a first general plane, with a bight portion joining the prongs at one end; a step member fixedly attached to an outer side of one prong so that it extends perpendicularly from the prong and lies in said first general plane with the two prongs; each prong having an inner stud-facing side with generally linear, parallel, spaced apart upper and lower edges which define second and third planes, one at each prong, the second and third planes being substantially perpendicular to the first plane and parallel to each other; and with a gripping means for holding the step-forming device in a selected position on a wall stud against slippage down the stud, the gripping means comprising a spring-loaded reciprocable member having a pointed tip for engaging the side of the wooden stud;

placing the portable step-forming device at a desired level on a vertical wall stud of a studwall open at least at one side, with the stud closely received between the two prongs and including manually retracting the reciprocable member against the spring when placing the step-forming device on the stud, then releasing the reciprocable member to let the pointed tip engage the stud to hold the step-forming device in place against slippage down the stud until the weight of a user is applied; and stepping on the step member and applying the weight of the user to the step member, thereby tending to slightly tip or pivot the step-forming device on the wooden stud and causing the edges of the prongs to press into the wooden stud a and to tightly grip the stud, preventing slipping of the step-forming device as it carries the weight of the user.

6. The method of claim 5, wherein the step member has an enlarged outer end, for helping retain the foot of the user on the step member.

* * * * *

UNITED STATES PATENT AND TRADEMARK OFFICE

CERTIFICATE OF CORRECTION

PATENT NO. : 4,696,372

DATED : September 29, 1987

INVENTOR(S) : Tom R. Fields

It is certified that error appears in the above-identified patent and that said Letters Patent is hereby corrected as shown below:

Column 4, line 66, before the word "stud", the following should be inserted: --stud to extend the step member to the left, or inverted and placed on the--.

Signed and Sealed this

Ninth Day of August, 1988

*Attest:*

*Attesting Officer*

DONALD J. QUIGG

*Commissioner of Patents and Trademarks*